US008608496B2

(12) United States Patent
Shenouda et al.

(10) Patent No.: US 8,608,496 B2
(45) Date of Patent: Dec. 17, 2013

(54) CONNECTOR FOR MULTI-PHASE CONDUCTORS

(75) Inventors: Antwan Shenouda, Mississauga (CA); Steve Strecker, Erin (CA); Nathan Tomes, Toronto (CA)

(73) Assignee: Pratt & Whitney Canada Corp., Longueuil (CA)

( * ) Notice: Subject to any disclaimer, the term of this patent is extended or adjusted under 35 U.S.C. 154(b) by 56 days.

(21) Appl. No.: 13/455,260

(22) Filed: Apr. 25, 2012

(65) Prior Publication Data

US 2013/0288498 A1 Oct. 31, 2013

(51) Int. Cl.
*H01R 4/60* (2006.01)

(52) U.S. Cl.
USPC ..... 439/213; 174/72 B

(58) Field of Classification Search
USPC ..... 439/210, 212, 213, 110, 114; 174/72 B, 174/71 B, 88 B, 77 R, 68.2
See application file for complete search history.

(56) References Cited

U.S. PATENT DOCUMENTS

| | | | | |
|---|---|---|---|---|
| 3,077,512 | A * | 2/1963 | Frostick | 174/71 B |
| 4,112,249 | A * | 9/1978 | Carlson | 174/68.2 |
| 5,011,421 | A | 4/1991 | Duke et al. | |
| 5,415,558 | A | 5/1995 | Baker | |
| 5,916,002 | A | 6/1999 | Gottschalk et al. | |
| 7,011,544 | B1 | 3/2006 | Zemba | |
| 7,148,423 | B2 | 12/2006 | Masuda et al. | |
| 7,166,804 | B2 | 1/2007 | Yumura et al. | |
| 7,168,974 | B2 | 1/2007 | Feldman et al. | |
| 7,265,297 | B2 | 9/2007 | Ashibe et al. | |
| 7,497,711 | B2 * | 3/2009 | Gherardini et al. | 439/212 |
| 7,595,445 | B2 * | 9/2009 | Legendre et al. | 174/33 |
| 7,608,785 | B2 | 10/2009 | Reis | |
| 7,936,100 | B2 | 5/2011 | Naganawa et al. | |
| 7,959,454 | B2 | 6/2011 | Ramasubramanian et al. | |
| 8,500,475 | B2 * | 8/2013 | Takehara et al. | 439/262 |
| 2008/0179969 | A1 | 7/2008 | Dooley et al. | |
| 2010/0012375 | A1 * | 1/2010 | Jur et al. | 174/88 B |
| 2010/0136808 | A1 | 6/2010 | Vanzo | |

FOREIGN PATENT DOCUMENTS

| | | |
|---|---|---|
| CN | 201383552 Y | 1/2010 |
| JP | 59162738 A | 9/1984 |

OTHER PUBLICATIONS

Lin et al. "An Improved Method for Constructing Multiphase Communications Protocols." IEEE Transactions on Computers [Online] 1993, vol. 42, Issue 1, pp. 15-26.

* cited by examiner

*Primary Examiner* — James Harvey
(74) *Attorney, Agent, or Firm* — Norton Rose Fulbright Canada LLP

(57) ABSTRACT

A connector for multi-phase conductors. The connector includes conductors for conducting multi-phase currents, and at least one conductive plate corresponding to each phase. Each conductive plate defines apertures for the conductors to pass through, there being at least one aperture in each conductive plate for each respective conductor. Each conductive plate includes at least one connecting member for forming an external electrical connection. Each conductor passes through a respective aperture of each conductive plate. Each conductor is selectively coupled to form electrical connection only to a conductive plate corresponding to the respective phase of the conductor.

20 Claims, 12 Drawing Sheets

CONNECTOR FOR MULTI-PHASE CONDUCTORS

TECHNICAL FIELD

The disclosure relates generally to electrical connectors, particularly connectors for multi-phase conductors.

BACKGROUND OF THE ART

In a multi-phase cable, there may be two or more conductors that carry current of the same phase. In a connector for such a cable, the challenge is how to recombine the conductors of the same phase and terminate them to the appropriate phase connectors in a space- and weight-efficient method. One option for separating the phases is to, at the end of the multi-phase cable, separate the conductors into several bundles, one for each phase, and connect the conductors of each phase with, for example, a lug.

SUMMARY

In some example aspects, the present disclosure provides a connector for multi-phase conductors, the connector may include: a plurality of conductors for conducting currents of two or more different phases, each phase being associated with two or more conductors and each conductor being associated with one respective phase; at least one conductive plate corresponding to each phase, each conductive plate defining apertures for the conductors to pass through, there being at least one aperture in each conductive plate for each respective conductor; and each conductive plate including at least one connecting member for forming an external electrical connection; wherein each conductor passes through a respective aperture of each conductive plate; and wherein each conductor is selectively coupled to form electrical connection only to a conductive plate corresponding to the respective phase of the conductor.

In some examples, the connector may include at least one insulating plate positioned between a pair of adjacent conductive plates corresponding to different phases.

In some examples, the connecting members may be for forming a mating external electrical connection.

In some examples, the connecting members may be one of: busbars, prongs and lugs.

In some examples, each conductor may be selectively insulated to expose the conductor for electrical connection only to at least one conductive plate corresponding to the respective phase of the conductor and to be insulated from electrical connection to any other conductive plates.

In some examples, the electrical connection may be a solder connection.

In some examples, the electrical connection may be formed by a tight fit between each connector and the conductive plate corresponding to the respective phase of the conductor.

In some examples, the connector may include an insulating material surrounding substantially all of the conductors and conductive plates except where each conductor is coupled to a respective conductive plate.

In some examples, the connector may include an anchor member.

In some examples, the conductors may be arranged such that each conductor of a given phase has, as immediate neighbors, only conductors of one or more different phases, and the apertures defined in the conductive plates preserve the arrangement of the conductors.

In some examples, the conductors may conduct currents corresponding to three different phases, and the connector may include at least three conductive plates, there being at least one conductive plate corresponding to each of the three different phases.

In some examples, the conductors may conduct currents corresponding to six different phases, and the connector may include at least six conductive plates, there being at least one conductive plate corresponding to each of the six different phases.

In some example aspects, there may be provided a method for assembling a multi-phase conductor, the method may include: providing a plurality of conductors for conducting currents of two or more different phases, each phase being associated with two or more conductors and each conductor being associated with one respective phase; providing at least one conductive plate corresponding to each phase, each conductive plate defining apertures for the conductors to pass through, there being at least one aperture in each conductive plate for each respective conductor; and passing each conductor through a respective aperture of a given conductive plate corresponding to a given phase of the two or more phases; forming an electrical connection between the given conductive plate and each conductor conducting current of the given phase; and repeating the passing and forming for all conductive plates.

In some examples, the method may include passing each conductor through a respective aperture of at least one insulating plate positioned between a pair of adjacent conductive plates corresponding to different phases.

In some examples, each conductor may be selectively insulated to expose the conductor for electrical connection only to at least one conductive plate corresponding to the respective phase of the conductor and to be insulated from electrical connection to any other conductive plates.

In some examples, forming the electrical connection may include forming a solder connection.

In some examples, forming the electrical connection may include forming a tight fit between the given conductive plate and each connector conducting current of the given phase.

In some examples, the method may include injecting an insulating material to surround substantially all of the conductors and conductive plates except where each conductor is coupled to a respective conductive plate.

In some examples, the conductors may be arranged such that each conductor of a given phase has, as immediate neighbors, only conductors of one or more different phases, and the apertures defined in the conductive plates preserve the arrangement of the conductors.

In some examples, the conductors may be pins, and the method may include connecting the pins to respective wires of a multi-phase cable.

Further details of these and other aspects of the subject matter of this application will be apparent from the detailed description and drawings included below.

DESCRIPTION OF THE DRAWINGS

Reference is now made to the accompanying drawings, in which.

DETAILED DESCRIPTION

Aspects of various example embodiments are described through reference to the drawings.

In a multi-phase cable, the arrangement of the conductors (e.g., wires and pins) described, for example, in U.S. Patent Application Publication No. 2008/0179969 (the entirety of which is hereby incorporated by reference) has been found to help in reducing the skin effect and proximity effect of a multi-phase connector when compared to separate bundles for each phase. The use of more than one conductor for a given phase may be useful where the diameter of each conductor is inversely related to the frequency of the conducted current, resulting in smaller conductors for higher frequencies. In such a case, the current of a given phase may be divided among multiple conductors to carry the full load. Such an arrangement may be useful in a cable where the conductors may extend for a significant length parallel to each other and where the skin effect and proximity effect may otherwise be significant.

Figure 1:
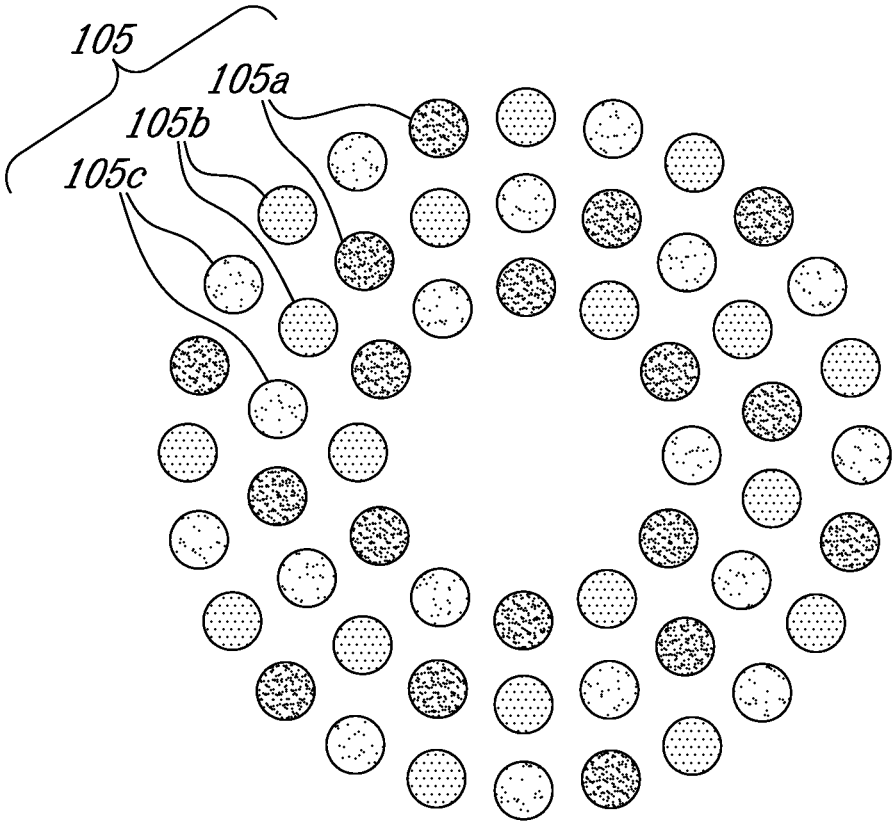
FIG. 1 shows an example arrangement of conductions suitable for use in an example of the disclosed multi-phase connector.

An example of this arrangement is shown in FIG. 1. Each of the conductors 105*a*, 105*b*, 105*c* (generally referred to as conductors 105) conducts current with a respective phase. In this example, there are three phases, namely Phase A, Phase B and Phase C. The conductors 105*a* conduct Phase A current, the conductors 105*b* conduct Phase B current and the conductors 105*c* conduct Phase C current. In this arrangement, each conductor 105 has only conductors 105 corresponding to different phase(s) as immediate neighbors. For example, a conductor 105*a* conducting current of Phase A has only conductors 105*b*, 105*c* conducting current of Phase B and/or Phase C as immediate neighbors.

A multi-phase cable incorporating this arrangement of conductors may be useful in various applications to conduct high frequency multi-phase currents. For example, such a cable may be used in engines, high speed motors and high speed generators.

One solution to forming a connector for such a cable is to gather the conductors of the same phase into separate bundles, and connect each bundle to, for example, a lug. However, this would require extra cable length, resulting in a relatively large and heavy connector. As well, gathering the conductors into separate bundles would remove the benefits of the conductor arrangement, and the conductors would thus be subject to the skin effect and proximity effect losses for the length of the connector.

Figure 2:
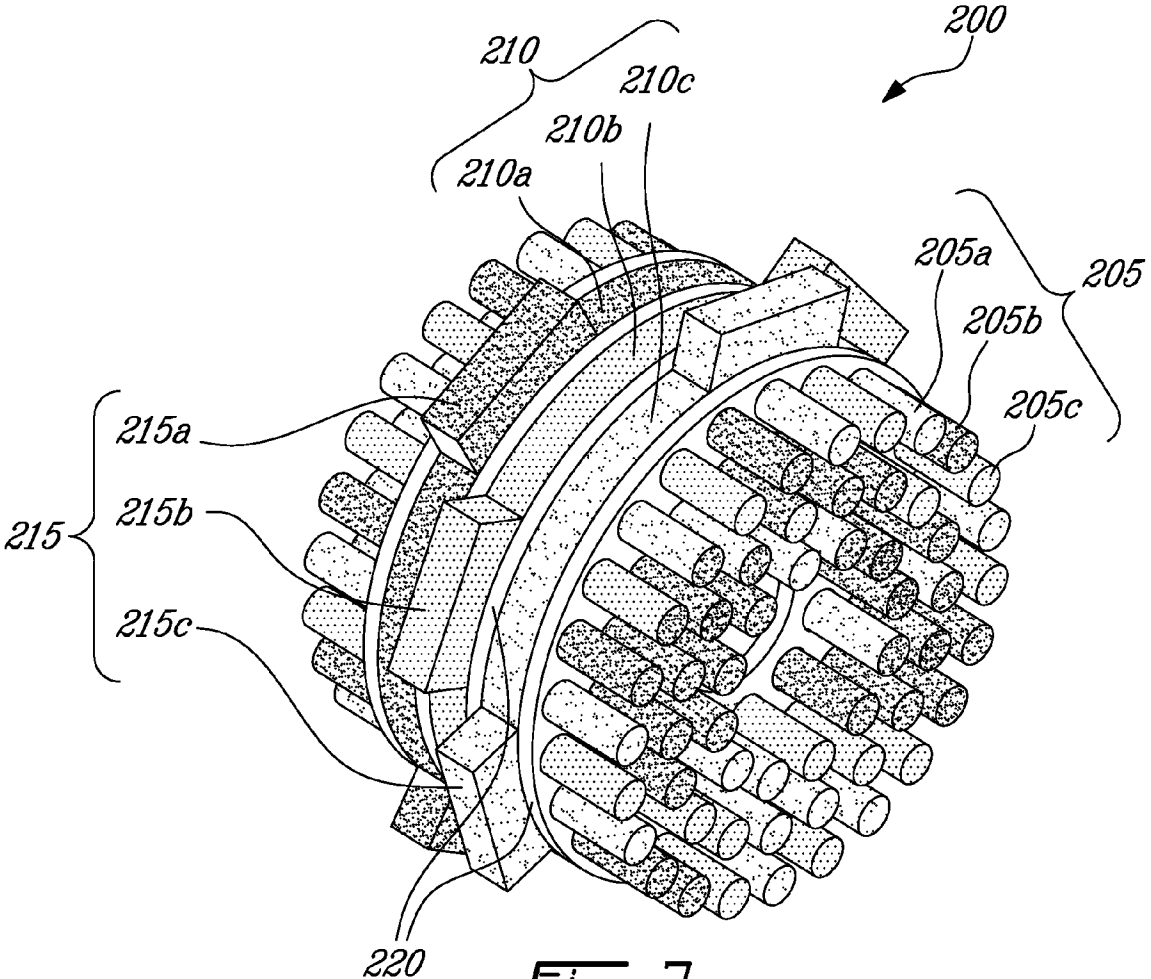
FIG. 2 shows an example embodiment of the disclosed multi-phase connector.

Reference is now made to FIG. 2, showing an example embodiment of the disclosed connector. In this example, the connector 200 includes conductors 205*a*, 205*b*, 205*c* (generally referred to as conductors 205). The conductors 205 may be the terminating ends of the conductors 105. The conductors 205 may be the same as the conductors 105. The conductors 205 may be connectors, such as pins, that are connected (e.g., soldered or crimped) onto the conductors 105. Each of the conductors 205 conducts current with a respective phase. In this example, there are three phases, Phase A, Phase B an Phase C. The conductors 205*a* conduct Phase A current, the conductors 205*b* conduct Phase B current and the conductors 205*c* conduct Phase C current. In this example, the conductors 205 are arranged in the arrangement of FIG. 1. However, it should be understood that the present disclosure is applicable for other arrangements.

The connector 200 also includes conductive plates 210*a*, 210*b*, 210*c* (generally referred to as conductive plates 210). Each conductive plate 210 is associated with a respective phase, and each phase is associated with at least one conductive plate 210. In this example, there are three conductive plates 210, each associated with one of three current phases—conductive plate 210*a* is associated with Phase A, conductive plate 210*b* is associated with Phase B and conductive plate 210*c* is associated with Phase C. In this example, the conductive plates 210 are shown as substantially circular plates having relatively equal diameters and thicknesses to each other. However, it should be understood that the conductive plates 210 may have other geometries and may have different dimensions and/or construction materials from each other. Although this example shows one conductive plate 210 for each phase, it should be understood that one or more phases may be associated with two or more conductive plates.

Each conductive plate 210 includes at least one respective connecting member 215*a*, 215*b*, 215*c* (generally referred to as connecting members 215) for forming an external electrical connection. The connecting members 215 may serve as the plug prongs of connector 200. In this example, each conductive plate 210 includes three connecting members 215 in the form of flanges or prongs, although other numbers and configurations of connecting members 215 may also be used. Although the connecting members 215 in this example are integrally formed with their respective conductive plates 210, it should be understood that the connecting members 215 may be electrically connected to the respective conductive plates 210 in other ways.

The connector 200 also includes one or more insulating plates 220. For example, there may be at least one insulating plate 220 at least between adjacent pairs of conductive plates 210 of different phases. The insulating plates 220 may help to insulate the conductive plates 210 from each other. The connector 200 may also include one or more insulating plates 220 at one or both ends of the stack of conductive plates 210. In some examples, the insulating plates 220 may not be used, for example where the conductive plates 210 are sufficiently spaced apart from each other.

Figure 3:
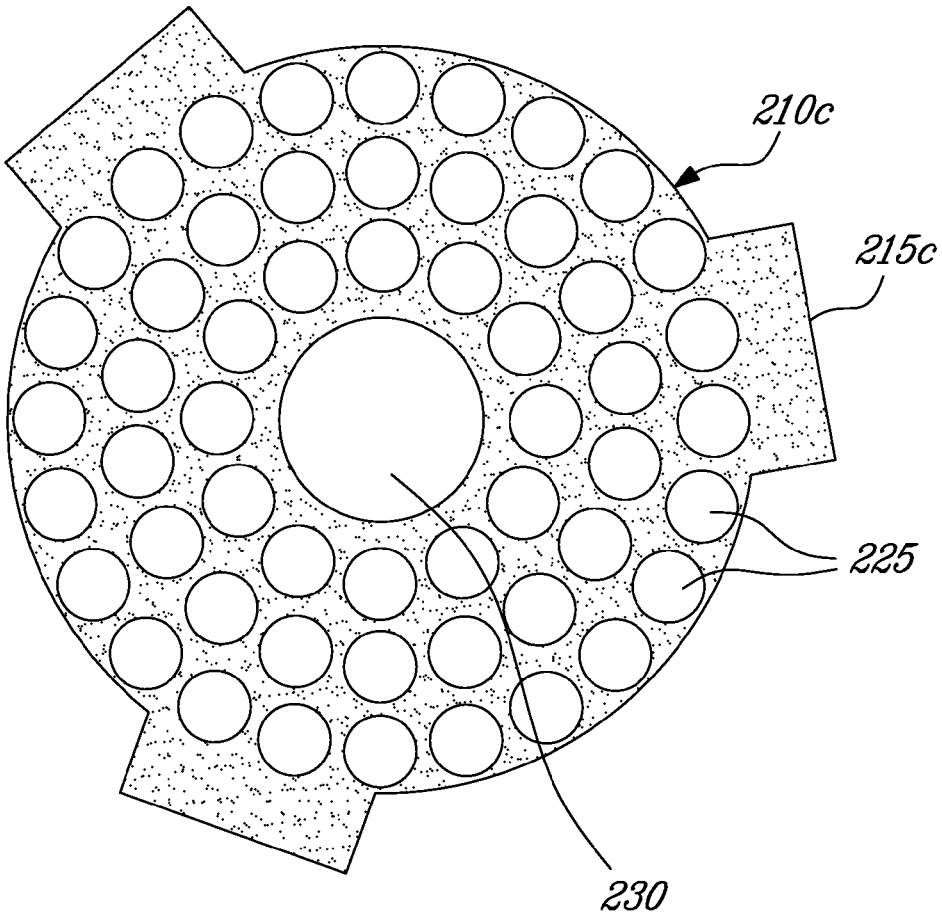
FIG. 3 shows an example conductive plate suitable for use in the connector of FIG. 2.

Reference is now made to FIG. 3, showing one conductive plate 210*a* from the example of FIG. 2. The conductive plate 210*a* shown is representative of the other conductive plates 210*b*, 210*c* of FIG. 2. The conductive plate 210 has defined therein apertures 225 to allow the conductors 205 to pass through the conductive plate 210. Each conductor 205 passes through a respective aperture 225. In this example, the apertures 225 are configured to substantially match the outer perimeter of the conductors 205 to form a relatively tight fit with each conductor 205.

In this example, the conductive plate 210*a* also has defined therein a central aperture 230. The central aperture 230 may be positioned where there are no conductors 105 in the arrangement of FIG. 1. The central aperture 230 may be provided to reduce the material and weight of the conductive plate 210*a* and/or to allow airflow in the connector 200. In some examples, the central aperture 230 may not be provided in the conductive plate 210.

In this example, the insulating plate(s) 220 also has defined therein apertures matching the apertures 225 and central aperture 230 of the conductive plates 210.

The conductive plates 210 and connecting members 215 may be formed from any suitable electrically conductive material including, for example, copper and/or aluminum.

The insulating plates 220 may be formed from any suitable insulating material.

Although the conductive plates 210 and the insulating plates 220 have been described as plates, it should be understood that the conductive plates 210 and the insulating plates 220 need not be in the form of plates. For example, the conductive plates 210 and/or the insulation plates 220 need not be planar, and need not be aligned perpendicularly to the conductors 205.

Figure 4A:
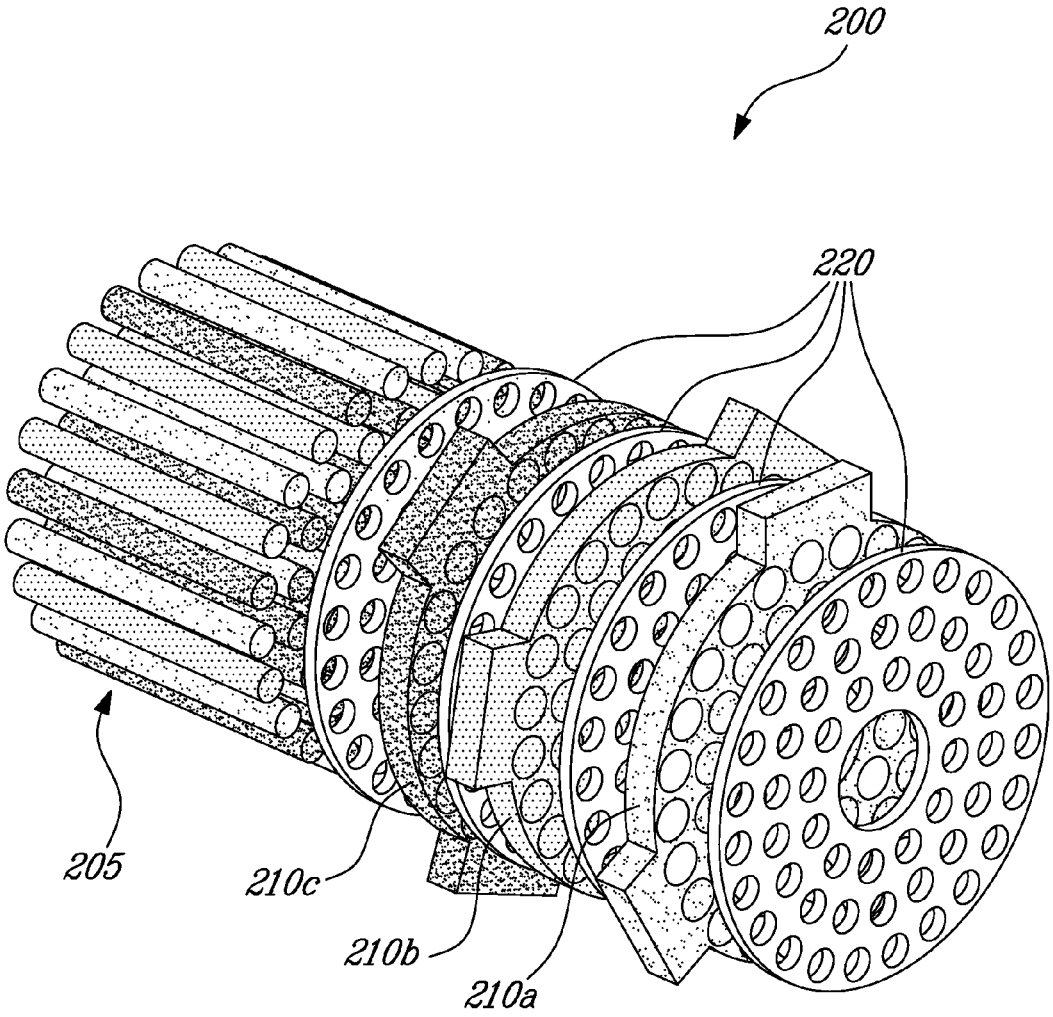
FIG. 4A shows an exploded view of the connector of FIG. 2.
Figure 4B:
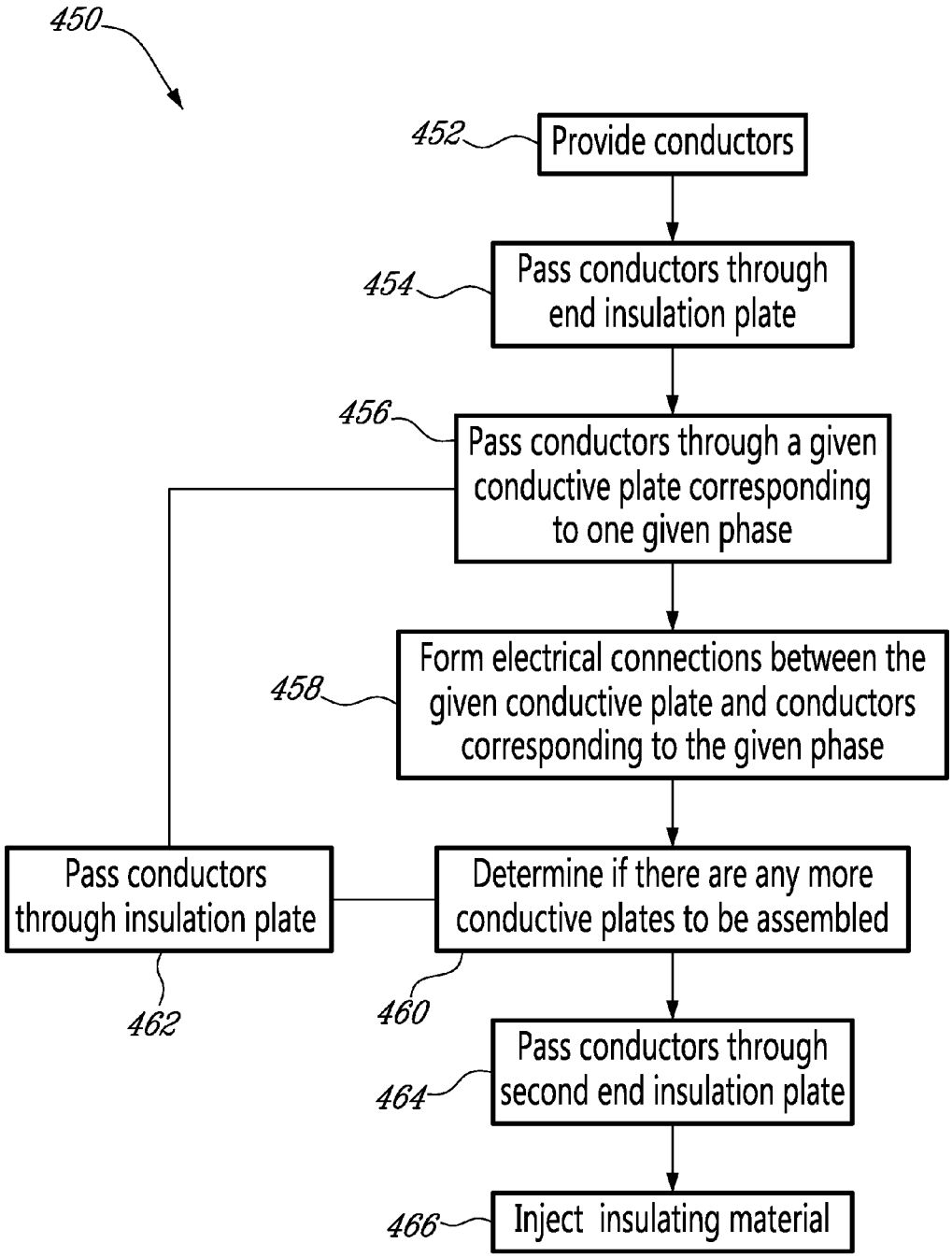
FIG. 4B shows a flowchart illustrating an example method of assembly of the disclosed multi-phase connector.

Reference is now made to FIGS. 4A and 4B. FIG. 4A shows the example connector 200 in an exploded view. FIG. 4B shows a flowchart illustrating an example method 450 of assembling the disclosed connector. The example method 450 is now described with reference to the connector 200. Although the method of assembly is described with reference to the connector 200, it should be understood that the method of assembly may be used for any other variation of the connector.

In the method 450, at 452 the conductors 205 are first provided. Where the conductors 205 are pins, the pins may be attached to the end of each wire conductor 105, for example by crimping.

The conductors 205 may be each provided with insulation that selectively exposes one or more portions of each conductor 205. The exposed portion(s) of each conductor 205 may allow the conductor 205 to form an electrical connection to the conductive plate 210 of the corresponding phase, while the remainder of the conductor 205 may be insulated from conductive plate(s) 210 of non-corresponding phase(s). That is, the conductors 205*a* may be insulated except for a portion that would pass through (as described below) conductive plate 210*a*. The insulation may be any suitable insulating material, for example a heat-shrink material, and may be sufficiently thin to allow the insulated conductors 205 to pass through the apertures 225 and may also be sufficiently thick to insulate the conductors 205 against unwanted electrical connection with conductive plate(s) 210 of non-corresponding phase(s).

At 454, the conductors 205 are passed through one insulation plate 220. This end insulation plate 220 may help to insulate the connector 200 from the rest of the multi-phase cable. This step may not be required, for example where it is not necessary for the connector 200 to provide insulation between the connector 200 and the rest of the multi-phase cable (e.g., where other means of insulation are provided by the cable).

At 456, the conductors 205 are passed through one of the conductive plates 210. In this example, each conductor 205 passes through a respective aperture 225 of the conductive plate 210, regardless of whether the conductive plate 210 is of a corresponding phase or non-corresponding phase. For example, where at 456 the conductive plate 210*a* corresponds to Phase A, all conductors 205*a*, 250*b*, 205*c* of all phases, including Phase B and Phase C, pass through the apertures 225 of the conductive plate 210*a*. Where the conductors 205 are arranged in a predetermined arrangement, such as the arrangement of FIG. 1, such arrangement is maintained when the conductors 205 are passed through the conductive plate 210.

At 458, the conductors 205 corresponding to the same phase as the conductive plate 210 that was just passed through are electrically connected to the conductive plate 210. The electrical connection may be made by soldering the appropriate subset of conductors 205 to the conductive plate 210. For example, where in step 456 the conductors 205 passed through the conductive plate 210*a* corresponding to Phase A, at 458 only the conductors 205*a* corresponding to Phase A are soldered to the conductive plate 210*a*. The remaining conductors 205*b*, 205*c* are not electrically connected to the conductive plate 210*a*.

In some examples, step 458 may not be required, such as where the appropriate conductors 205 form a tight fit with the conductive plate 210 at non-insulated portion(s) of the conductors 205, thereby forming a sufficient electrical connection. For example, the conductors 205*a* may be insulated along their entire lengths except for non-insulated portion(s) on each conductor 205*a* that correspond with where the conductors 205*a* meet the conductive plate(s) 210*a* of the corresponding phase in a tight fit, thereby forming an electrical connection between each conductor 205*a* and the conductive plate(s) 210*a*.

At 460, it is determined whether there is any other conductive plate 210 to be assembled. If there is, the method 450 proceeds to step 462. If there is no other conductive plate 210, the method 450 proceeds to step 464.

At 462, the conductors 205 are passed through another insulation plate 220. The insulation plate 220 may serve to provide insulation between the conductive plate 210 that was just passed through in step 456, and the next conductive plate 210. The step 462 may not be required, for example where there is sufficient spacing between adjacent conductive plates 210 to forego insulation, or where other methods are used to insulate the conductive plates 210 from each other (e.g., injection of insulating material, or where the conductive plates 210 themselves are coated with an insulating material). The method 450 then returns to step 456.

At 464, after all the conductive plates 210 have been assembled, the conductors 205 are passed through another insulation plate 220. This second end insulation plate 220 may help to insulate the connector 200 from the external environment. The step 464 may not be required, for example where it is not necessary for the connector 200 to provide insulation between the connector 200 and the external environment (e.g., where other means of insulating the connector, such as a connector cover, is provided).

At 466, an insulating material (not shown) is introduced into the connector 200. For example, the insulating material may be injected, vacuum impregnated or otherwise introduced into the entire connector 200. The insulating material may be sufficiently flowing to fill in substantially all the space in the connector 200, including any spacing between adjacent conductive plates 210 and any spacing between a conductive plate 210 and conductors 205 not electrically connected or tightly fitted to that conductive plate 210, thereby insulating against unwanted electrical connections. The insulating material may be allowed to set or cure (e.g., by air drying or with a curing aid such as heat). Vacuum impregnation of the insulating material into the connector 200 may also help to reduce or eliminate creepage paths between conductors/plates of different phases, while maintaining a relatively compact size for the connector 200.

The combination of both an insulation tubing about each conductor 205 and an injected insulating material may help to prevent problems that might otherwise arise from using only one method of insulation. For example, using only insulation tubing may not be sufficient where the insulation tubing must be thin, while using only injected insulating material may not be able to insulate against unintentional electrical connections between conductors 205 and conductive plate(s) 210 of non-corresponding phase(s) due to misalignment of the conductors 205 (e.g., arising from manufacturing error).

In some examples, such as where the insulation tubing is sufficiently thick, injected insulating material may not be required and step 466 may not be required.

The method 450 ends.

Figure 5:
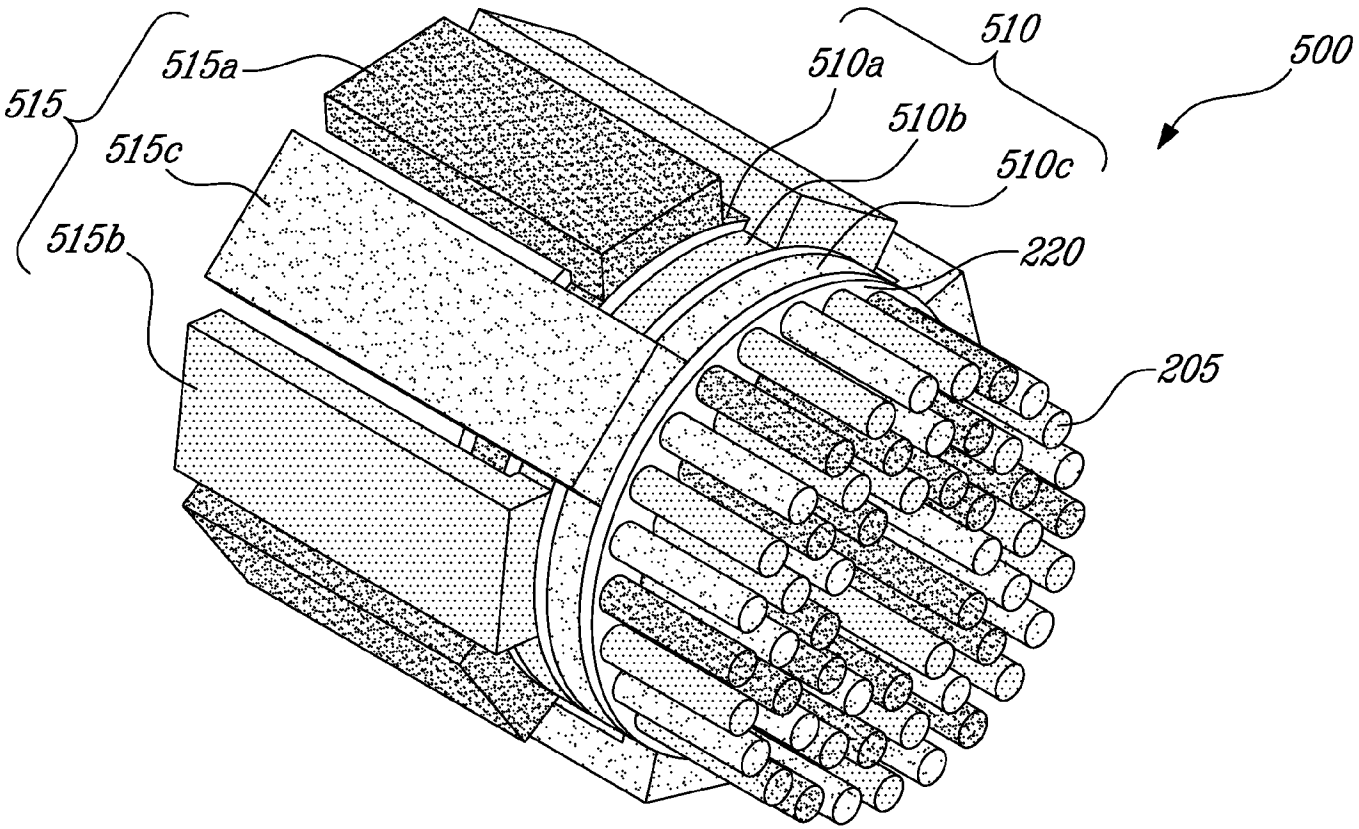
FIG. 5 shows another example embodiment of the disclosed multi-phase connector.

Reference is now made to FIG. 5, showing another example embodiment of the disclosed connector. The connector 500 may be substantially similar to the connector 200, including conductors 205 in a similar arrangement, optionally insulating plate(s) 220, and appropriate insulation.

The connector 500 includes conductive plates 510*a*, 510*b*, 510*c* (generally referred to as conductive plates 510) in place of conductive plates 210. Conductive plates 510 may be similar to conductive plates 210 in geometry, dimensions and overall configuration. However, each conductive plate 510 includes one or more connecting members 515*a*, 515*b*, 515*c* (generally referred to as connecting members 515) in the form of prongs extending from the conductive plate 510 and substantially parallel to the longitudinal axis of the connector 500. The connecting members 515 may serve as connecting prongs of the connector 500.

Figure 6A:
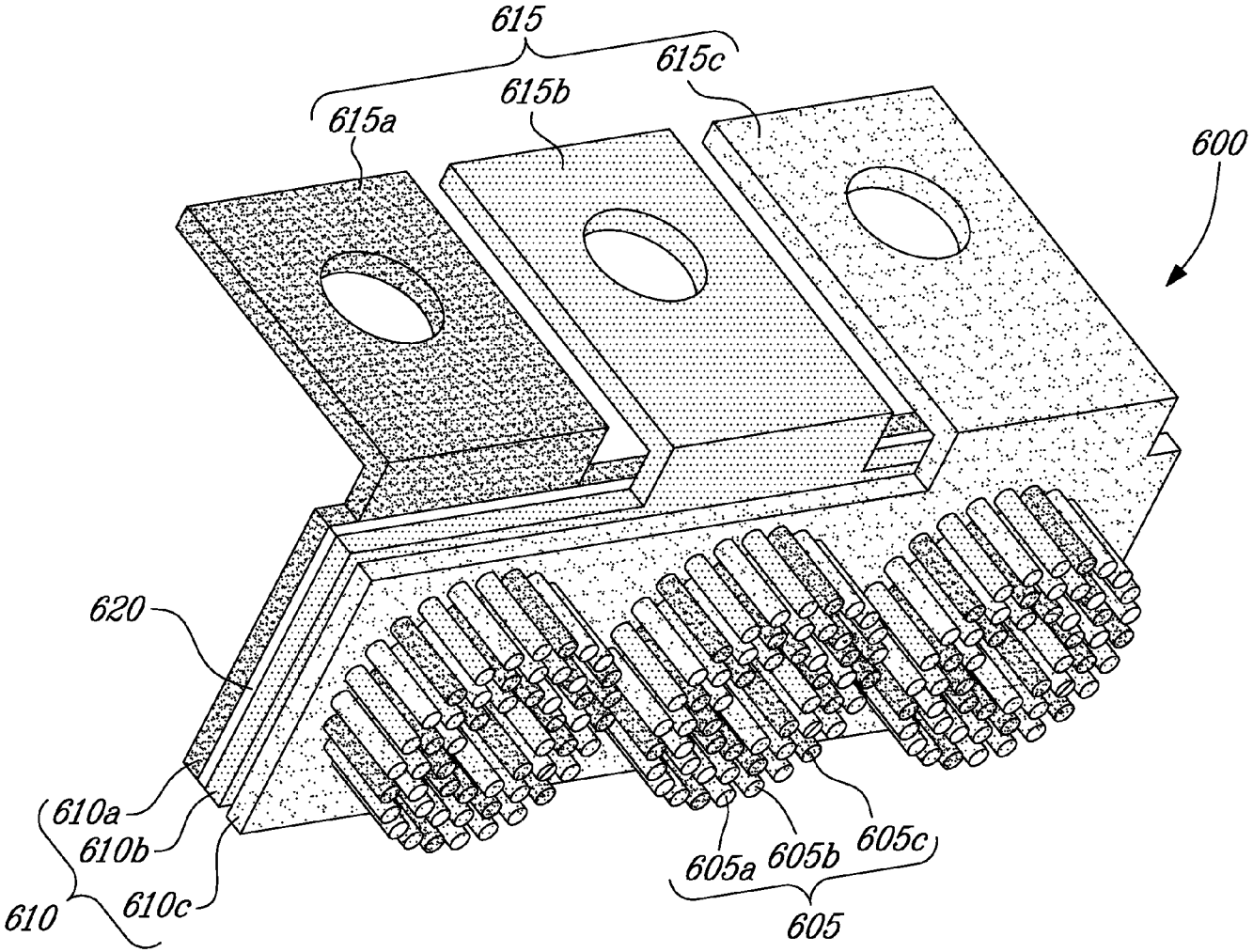
FIGS. 6A and 6B show another example embodiment of the disclosed multi-phase connector.
Figure 6B:
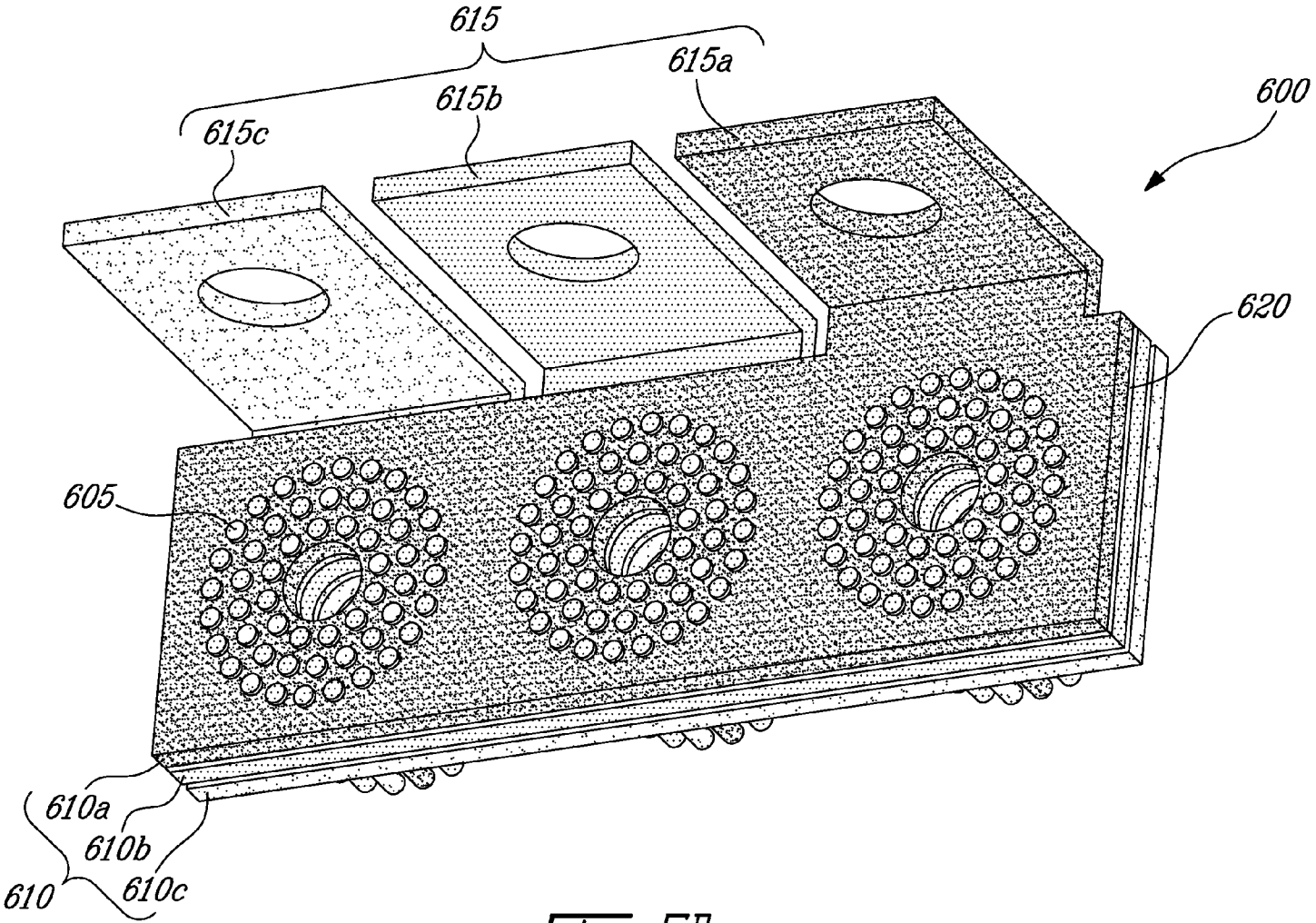
Figure 7:
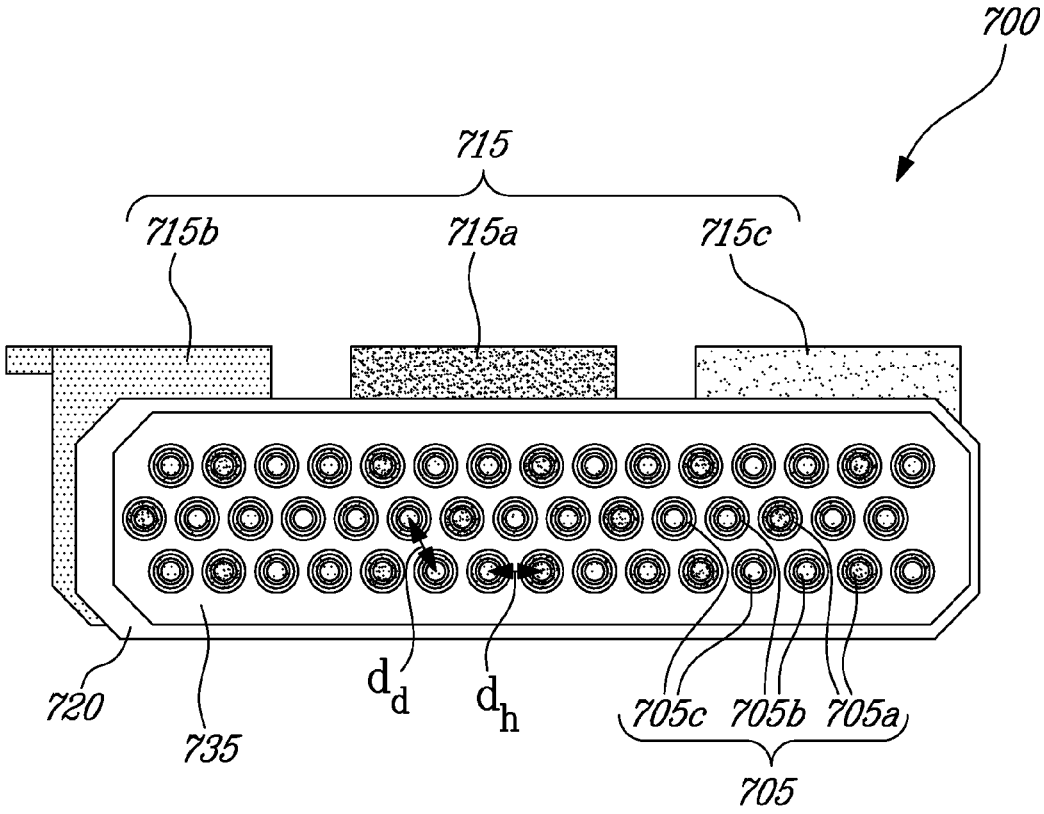
FIGS. 7-10 show another example embodiment of the disclosed multi-phase connector.

Reference is now made to FIGS. 6A and 6B, showing another example embodiment of the disclosed connector. In the connector 600, the conductors 605*a*, 605*b*, 60*bc* (generally referred to as conductors 605) are arranged in three separate groups, in this case three circular groups each group being similar to the arrangement of FIG. 1. The connector 600 includes conductive plates 610*a*, 610*b*, 610*c* (generally referred to as conductive plates 610) each having at least one respective connecting member 615*a*, 615*b*, 615*c* respectively (generally referred to as connecting members 615) in the form of lugs. The connector 600 also includes one or more insulating plates 620 positioned at least between pairs of adjacent conductive plates 610 of different phases.

The connector 600 may be useful in providing a single connector 600 for multiple bundles of conductors 605 (in this example, three bundles of conductors 605, such as from three separate multi-phase cables). Using the connector 600 avoids separating the conductors 605 of each bundle into groups according to phase, which would require significant amounts of space and/or cable length.

Figure 8:
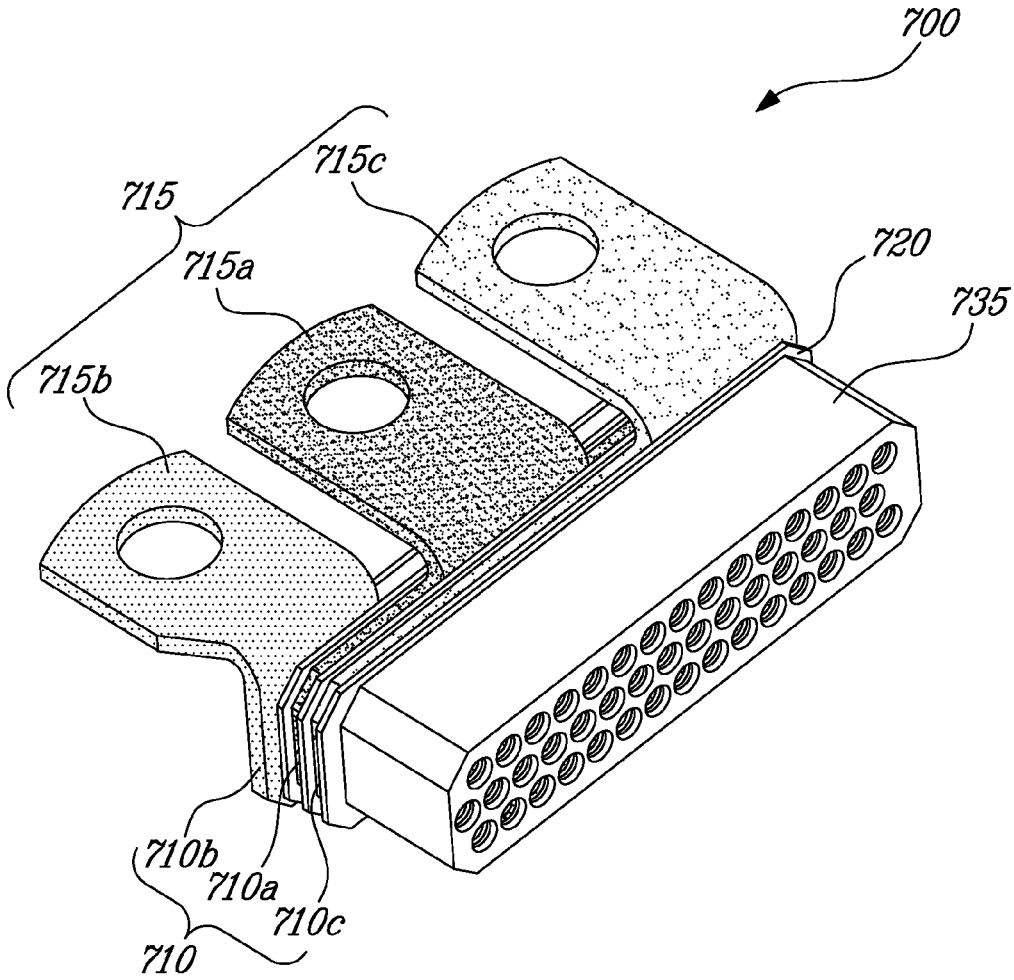
Figure 9:
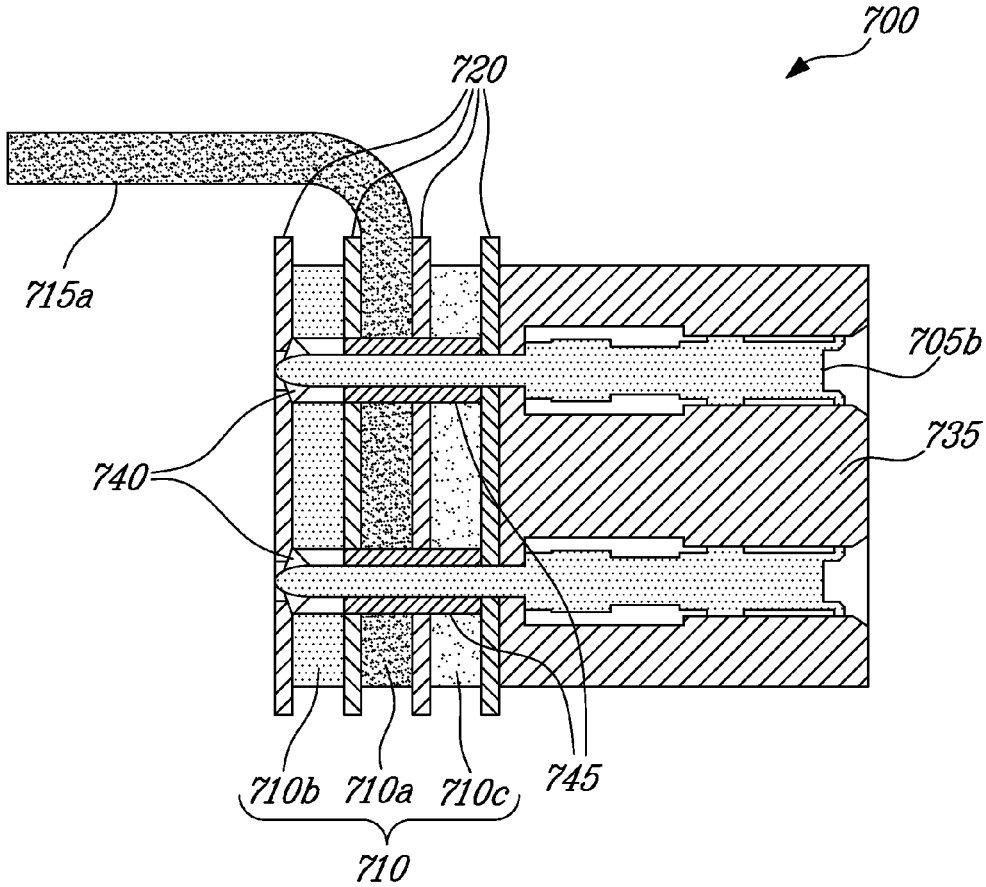
Figure 10:
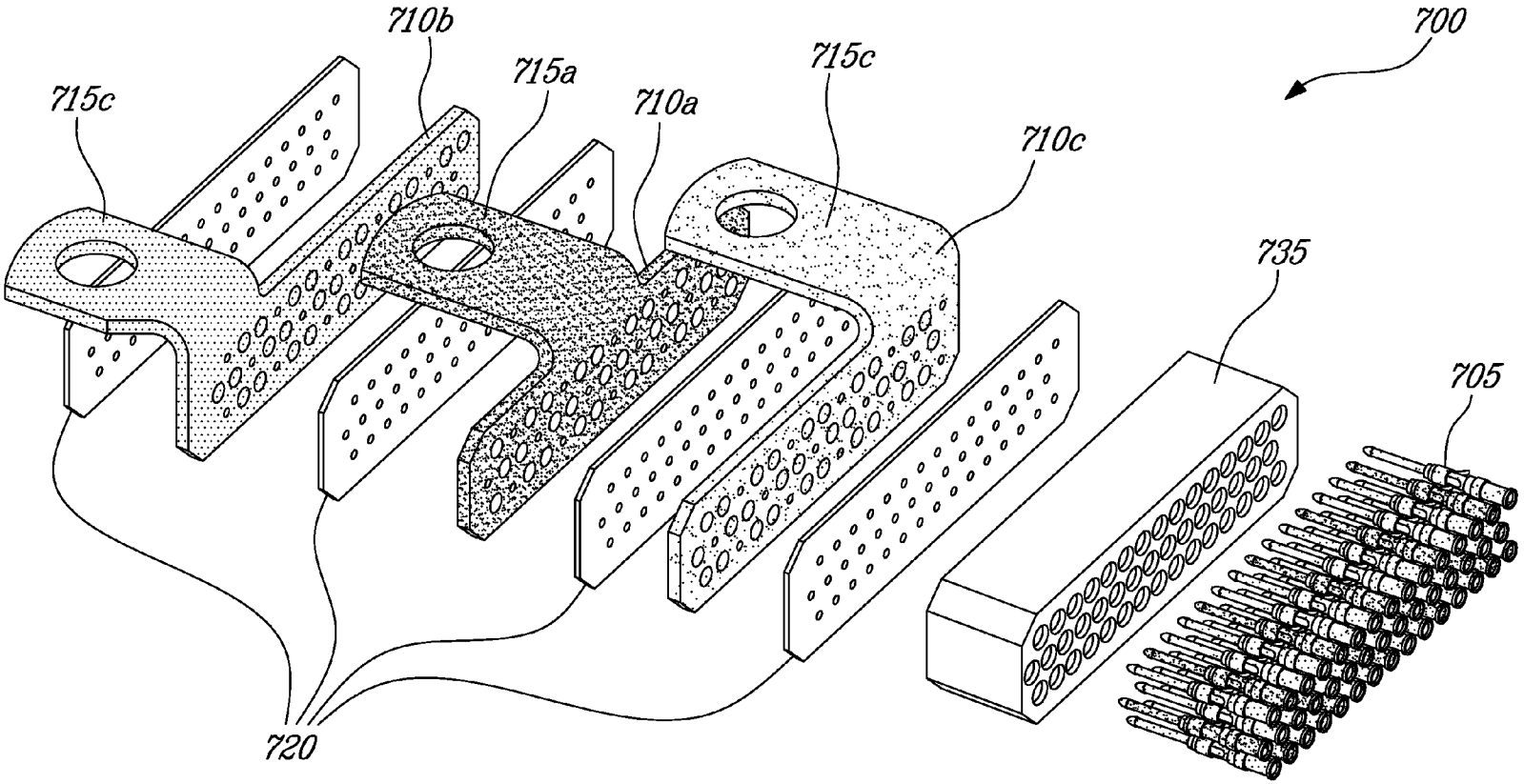

Reference is now made to FIGS. 7-10 showing another example embodiment of the disclosed connector. FIG. 1 shows the example connector 700 in a front view, FIG. 8 shows the connector 700 in an isometric view, FIG. 9 shows a cross-sectional view of the connector 700, and FIG. 10 shows an exploded view of the connector 700.

In this example, the connector 700 is designed to accommodate conductors 705*a*, 705*b*, 705*c* (generally referred to as conductors 705) arranged in a rectangular pattern. In this example, the conductors 705 are arranged such that each conductor 705 has only conductors 705 corresponding to different phase(s) as immediate neighbors, similar to that described for the arrangement of FIG. 1. In this example, the conductors 705 are pins that may be crimped onto wires or other conductors (not shown) In this example, the conductors 705 are arranged with a horizontal distance $d_h$ of about 0.2 inches between immediate neighbors and a diagonal distance $d_d$ of about 0.22361 inches between immediate neighbors.

The connector 700 includes conductive plates 710*a*, 710*b*, 710*c* (generally referred to as conductive plates 710) each including one or more connecting members 715*a*, 715*b*, 715*c* respectively (generally referred to as connecting members 715) in the form of lugs. The conductive plates 710 are configured to accommodate the arrangement of the conductors 705. It should be understood that although the conductive plates 710 are generally rectangular in shape, matching the rectangular arrangement of the conductors 705, the geometry of the conductive plates 710 need not match the geometry of the arrangement of the conductors 705. It should be understood that although the connecting members 715 are shown as lugs, the connecting members 715 may be in other forms including, for example, flanges or prongs. The connector 700 includes one or more insulating plates 720, at least between adjacent pairs of conductive plates 710 of different phases.

The connector 700 in this example also includes an anchor member 735 that may serve to anchor the conductors 705 and help to properly align each conductor 705 in the connector 700. The anchor member 735 may also help to improve the robustness and durability of the connector 700. Although not shown in other examples, each of the connectors 200, 500, 600 may also include a similar anchor member. The anchor member may be made of an insulating material, for example a lightweight polymer.

In the cross-section shown in FIG. 9, the connector 700 is shown with the electrical connection between the conductors 705 and the respective conductive plates 710 being formed by solder connections 740. For example, the conductors 705*b* conducting current of Phase B are shown with solder connections 740 to the conductive plate 710*b* corresponding to Phase B. The conductors 705 are also each provided with insulation tubing 745 to selectively insulate each conductor 705 to allow for electrical connections only with conductive plate(s) 210 of the corresponding phase. Although the solder connections 740 and the insulation tubing 745 has been shown only for the connector 700, it should be understood that the connectors 200, 500, 600 and other variations may also include solder connections and/or insulation tubing.

The disclosed connector may be useful to help in reducing the weight, size and/or electrical resistance of the connection between multi-phase connector pins, (e.g., when arranged as described in U.S. Patent Application Publication No. 2008/0179969), and the appropriate phase connections. By maintaining the arrangement of the conductors through the connector rather than gathering the conductors into separate bundles grouped by phase, the disclosed connector may help to reduce ohmic losses by eliminating the need to regroup the conductors into separate phase bundles, thereby avoiding an increase in the overall cable length and avoiding losses from skin and proximity effects. The reduced cable length will also help to achieve a smaller and/or lighter connector.

The disclosed connector may be used as a connector plug or receptacle. The disclosed connector may be used to facilitate a connection between a plurality of wires (typically a large number of wires) to external connections at a junction (e.g., between separate units).

The disclosed connector may be useful in applications using multi-phase cables to conduct high frequency multi-phase currents. For example, the disclosed connector may be useful in engines, high speed motors and high speed generators.

Although the examples disclosed show the connector having circular or rectangular geometries, it should be understood that the disclosed connector may have any suitable configuration. For example, a circular configuration may be used for a more compact connector while a rectangular configuration may be used for a more conveniently adaptable connector, while other geometries (e.g., square, triangular or irregular) and configurations may be used to accommodate the arrangement of conductors and/or to match external connections.

In some examples, the conductive plates may be phase busbars inside a unit, in which case, the conductive plates may serve as the receptacle of the connector and the conductors (e.g., pins) may serve as the plug of the connector.

Although the disclosure has referred to example connectors for a three-phase cable, it should be understood that the connector may be modified as appropriate to serve as a multi-phase connector for more or less phases including, for example, six-phase systems (e.g., by increasing or decreasing the number of conductive plates accordingly). The disclosed connector may also be used to provide a single connection for two or more multi-phase cables (e.g., as in the example embodiment of connector 600).

In the examples disclosed, the connector uses connecting members in the form of busbars, prongs and lugs to provide an external electrical connection. In other examples, the connector may use the conductors themselves (e.g., pins) as the male connection and the conductive plates as the female connection. Such a configuration may include the use of biasing members (e.g., socket springs or coils) around the conductors in the locations on a connecting fact of the connector where the external connection should be made and providing insulating material everywhere else. Such a configuration may be suitable for end-on connection of two multi-phase cables having the same conductor arrangement.

In some examples, where the connecting members are in the form of prongs, one or more of the prongs may be twisted to have a radial orientation, which may help to prevent misalignment of the connector when making an external electrical connection.

In some examples, the connector may be used to translate or convert conductors from a conducting arrangement (e.g., as shown in FIG. 1) to a connection arrangement (e.g., lugs or prongs). Thus, the connector may provide an intermediate step between a conducting arrangement and a connection arrangement.

The above description is meant to be exemplary only, and one skilled in the art will recognize that changes may be made to the embodiments described without departing from the scope of the invention disclosed. For example, the conductors may have any suitable dimensions and/or cross-sectional geometries, and may be arranged in any suitable configuration. The geometries and/or dimensions of each conductive plate and/or insulating plate may be different. Any suitable conductive material may be used for the conductors and the conductive plates, and any suitable insulating material may be used for the insulating plates and any injected insulating material. The connector may be configured to accommodate any number of phases. Still other modifications which fall within the scope of the present invention will be apparent to those skilled in the art, in light of a review of this disclosure, and such modifications are intended to fall within the appended claims.

The invention claimed is:

1. A connector for multi-phase conductors, the connector comprising:

a plurality of conductors for conducting currents of two or more different phases, each phase being associated with two or more conductors and each conductor being associated with one respective phase;

at least one conductive plate corresponding to each phase, each conductive plate defining apertures for the conductors to pass through, there being at least one aperture in each conductive plate for each respective conductor; and each conductive plate including at least one connecting member for forming an external electrical connection;

wherein each conductor passes through a respective aperture of each conductive plate; and wherein each conductor is selectively coupled to form electrical connection only to a conductive plate corresponding to the respective phase of the conductor.

2. The connector of claim 1, further comprising at least one insulating plate positioned between a pair of adjacent conductive plates corresponding to different phases.

3. The connector of claim 1 wherein the connecting members are for forming a mating external electrical connection.

4. The connector of claim 1 wherein the connecting members are one of: busbars, prongs and lugs.

5. The connector of claim 1 wherein each conductor is selectively insulated to expose the conductor for electrical connection only to at least one conductive plate corresponding to the respective phase of the conductor and to be insulated from electrical connection to any other conductive plates.

6. The connector of claim 1 wherein the electrical connection is a solder connection.

7. The connector of claim 1 wherein the electrical connection is formed by a tight fit between each connector and the conductive plate corresponding to the respective phase of the conductor.

8. The connector of claim 1, further comprising an insulating material surrounding substantially all of the conductors and conductive plates except where each conductor is coupled to a respective conductive plate.

9. The connector of claim 1, further comprising an anchor member.

10. The connector of claim 1, wherein the conductors are arranged such that each conductor of a given phase has, as immediate neighbors, only conductors of one or more different phases, and the apertures defined in the conductive plates preserve the arrangement of the conductors.

11. The connector of claim 1, wherein the conductors conduct currents corresponding to three different phases, and the connector comprises at least three conductive plates, there being at least one conductive plate corresponding to each of the three different phases.

12. The connector of claim 1, wherein the conductors conduct currents corresponding to six different phases, and the connector comprises at least six conductive plates, there being at least one conductive plate corresponding to each of the six different phases.

13. A method for assembling a multi-phase conductor, the method comprising:

providing a plurality of conductors for conducting currents of two or more different phases, each phase being associated with two or more conductors and each conductor being associated with one respective phase;

providing at least one conductive plate corresponding to each phase, each conductive plate defining apertures for the conductors to pass through, there being at least one aperture in each conductive plate for each respective conductor; and passing each conductor through a respective aperture of a given conductive plate corresponding to a given phase of the two or more phases;

forming an electrical connection between the given conductive plate and each conductor conducting current of the given phase; and repeating the passing and forming for all conductive plates.

14. The method of claim 13 further comprising passing each conductor through a respective aperture of at least one insulating plate positioned between a pair of adjacent conductive plates corresponding to different phases.

15. The method of claim 13 wherein each conductor is selectively insulated to expose the conductor for electrical connection only to at least one conductive plate corresponding to the respective phase of the conductor and to be insulated from electrical connection to any other conductive plates.

16. The method of claim 13 wherein forming the electrical connection comprises forming a solder connection.

17. The method of claim 13 wherein forming the electrical connection comprises forming a tight fit between the given conductive plate and each connector conducting current of the given phase.

18. The method of claim 13, further comprising injecting an insulating material to surround substantially all of the conductors and conductive plates except where each conductor is coupled to a respective conductive plate.

19. The method of claim 13, wherein the conductors are arranged such that each conductor of a given phase has, as immediate neighbors, only conductors of one or more different phases, and the apertures defined in the conductive plates preserve the arrangement of the conductors.

20. The method of claim 13, wherein the conductors are pins, further comprising connecting the pins to respective wires of a multi-phase cable.

* * * * *